US007661616B2

(12) United States Patent
Magula

(10) Patent No.: US 7,661,616 B2
(45) Date of Patent: Feb. 16, 2010

(54) CHOPPER AND METHOD OF CHOPPING UNWOUND ITEMS

(75) Inventor: Miroslav Magula, Trnava (SK)

(73) Assignee: Johns Manville, Denver, CO (US)

( * ) Notice: Subject to any disclaimer, the term of this patent is extended or adjusted under 35 U.S.C. 154(b) by 589 days.

(21) Appl. No.: 11/588,984

(22) Filed: Oct. 27, 2006

(65) Prior Publication Data

US 2008/0098865 A1 May 1, 2008

(51) Int. Cl.
*B02C 7/04* (2006.01)

(52) U.S. Cl. ..... 241/235; 241/DIG. 30

(58) Field of Classification Search ..... 241/235, 241/DIG. 30
See application file for complete search history.

(56) References Cited

U.S. PATENT DOCUMENTS

| | | | | |
|---|---|---|---|---|
| 2,890,493 | A * | 6/1959 | Clark | 19/65 R |
| 3,508,461 | A | 4/1970 | Stream | |
| 3,869,268 | A | 3/1975 | Briar et al. | |
| 4,083,279 | A | 4/1978 | Wester et al. | |
| 4,249,441 | A | 2/1981 | Sturtz | |
| 4,287,799 | A | 9/1981 | Fujita et al. | |
| 4,398,934 | A | 8/1983 | Willis et al. | |
| 4,551,160 | A | 11/1985 | Frailey et al. | |
| 6,598,814 | B2 * | 7/2003 | Bascom et al. | 440/88 F |
| 6,619,573 | B2 * | 9/2003 | Arterburn et al. | 241/30 |
| 7,413,136 | B2 * | 8/2008 | Bascom et al. | 241/30 |

* cited by examiner

*Primary Examiner*—Faye Francis
(74) *Attorney, Agent, or Firm*—Robert J. Touslee

(57) ABSTRACT

A method and apparatus for separating long, unwound items like fiber, fiber strands, yarn, etc. into short lengths is disclosed. The apparatus has a backup roll, a blade roll that uses novel dummy blade slot fillers between each pair of chopping blades on the blade roll to eliminate or substantially reduce vibration normally encountered when making longer chopped lengths of chopped product.

13 Claims, 3 Drawing Sheets

FIG. 2A
(PRIOR ART)
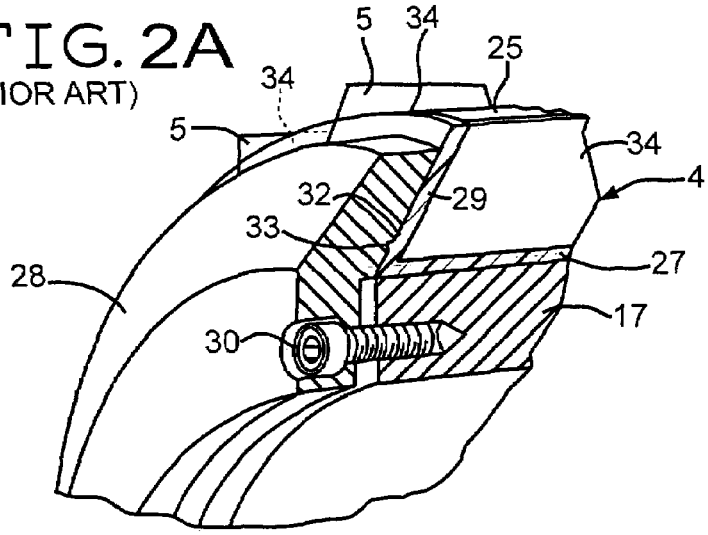
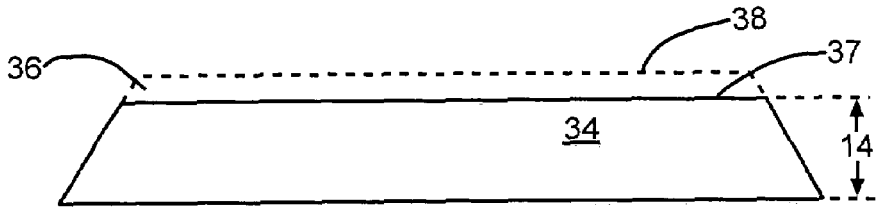
FIG. 2B
(PRIOR ART)
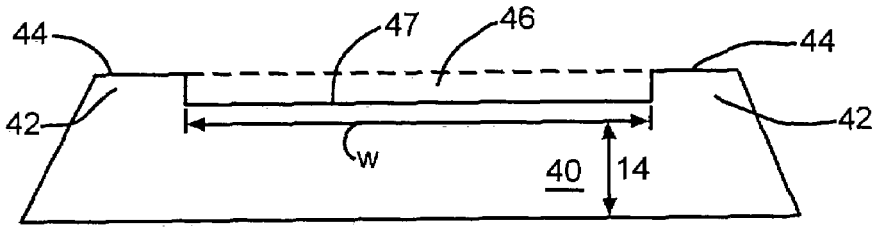
FIG. 3
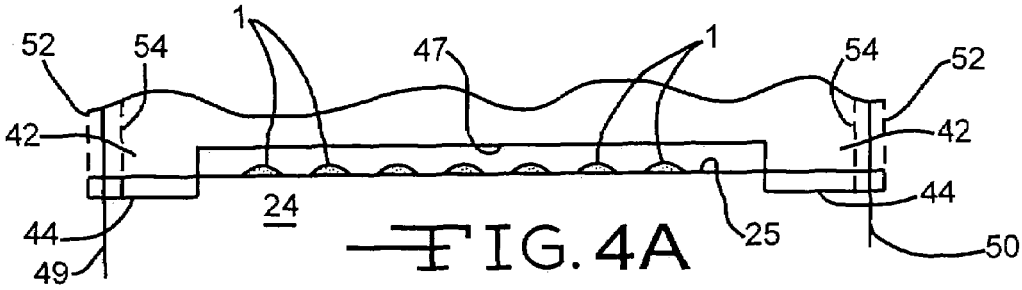
FIG. 4A

CHOPPER AND METHOD OF CHOPPING UNWOUND ITEMS

BACKGROUND

The present invention involves an improved chopper for chopping continuous or very long loose items such as fiber, fiber strands, yarn, wire, string, ribbon, tape and the like by pulling the item(s) into the chopper while the loose items are held tightly against the surface of a rotating backup roll and carrying the item(s) on into a nip between a rotating blade roll and the rotating backup roll where they are separated into short pieces. More specifically the present invention involves an improved chopper having an improved blade roll and a method of using the improved chopper to make chopped products.

It has long been known to chop continuous fibers or fiber strands into lengths of about 1-5 inches or shorter. Billions of pounds of such product including chopped glass fibers and fiber strands are produced each year in process and chopping apparatus such as disclosed in U.S. Pat. Nos. 5,970,837, 4,551,160, 4,398,934, 3,508,461, and 3,869,268, the disclosures of which are incorporated herein by reference. The choppers disclosed in these patents comprise a blade roll containing a plurality of spaced apart blades for separating the fibers into short lengths, a backup roll, often or preferably driven, which the blades work against to effect the separation and which pulls the fibers or fiber strands and in some cases, an idler roll to hold the fibers or fiber strands down onto the surface of the backup roll. In the chopped fiber processes disclosed in these patents, the chopper is often the item most limiting the productivity of the processes. These processes typically operate continuously every day of the year, 24 hours each day, except for furnace rebuilds every 5-10 years.

Many of the above choppers use a blade roll made using an elastomeric material layer such a rubber, polyurethane, or other material having similar elastomeric properties, for holding spaced apart blades in spaced apart slots in the elastomeric layer, see U.S. Pat. Nos. 4,083,279 and 4,287,799. In a large operation, many blade rolls must be inventoried to service a plurality of choppers making several different products at any one time, one of the differences in the chopped products being length of the chopped product. To minimize the number of blade rolls that must be inventoried to support a substantial operation, it has been the practice to form blade slots on a 0.25 inch (6 mm) or 0.5 inch (12-13 mm) center to or 0.5 inch (12-13 mm) center to center spacing in all of the backup rolls. The final blade roll are then made up to make a particular product or group of products close to the time they are needed. In making up the blade rolls, blades are placed only in the slots appropriate for making the chopped length desired for chopper and product to be produced with those blade rolls. When making a 1.25 inch (31 mm) long product, several slots are left empty between the blades that are inserted on 1.25 inch blade edge to blade edge spacings. Dummy filler pieces were normally placed in the empty slots to present a smooth surface to the backup roll and to maintain pressure on the sides of the blades setting in the slots of the blade roll. These dummy filler pieces filled the slots the same as blades, but ended at or just below the top surface of the elastomeric layer of the blade roll.

These choppers run at speeds such that the surface speed of the backup roll and the edge of the blades move at thousands of feet per minute, i.e. from 2,000 to more than 6,000 feet per minute, such as 7,000 to 10,000 feet per minute. It has not been discovered that this practice of using dummy filler pieces in the slots between blades in the blade roll, while necessary to maintain the integrity of the blades and elastomeric layer of the blade roll, nevertheless causes vibration at these chopping speeds and when the distance between the blades is about one inch or longer. More than half of the fiber produced in the United States is one inch long or longer and a substantial, and growing, amount of fiber produced in elsewhere in the world is about one inch long or longer. This vibration, chatter, reduces the life of the backup roll substantially over what it could be without vibration, is very noisy, reduces the quality of the chopped fiber and causes significant scrap because of sling-off of good fiber onto the forming room floor and onto the chopper itself and probably leads to equipment damage such as bearings and shafts supporting the blade roll and the backup roll and other parts. Because of the cost of shutting a chopper down to replace any part on the chopper—all bushings feeding the chopper make only scrap while the chopper is down and operating equilibrium is upset causing a lowered operating efficiency for a period of time after startup—it is cost effective to also change the blade roll while the chopper is down even though it may have many hours of life left. A solution to this problem has been sorely needed for a long time.

SUMMARY OF THE INVENTION

The present invention is an improved chopper for separating long lengths of one or or more unwound items selected from a group consisting of fibers, fiber strands, wires, strings, tape(s), strip(s) and ribbon(s) into lengths of about one inch long or longer. One or more, preferably a plurality long lengths of one or more of the items described above are pulled into the chopper in an unwound form at speeds exceeding 1,000 FPM, more typically at speeds exceeding 2000 FPM. The chopper pulls the item(s) into a nip between the elastomer working layer of the backup roll and the chopping portion of the blades of a rotating blade roll. Both the blade roll and the backup roll are typically outboard of a front of a cabinet that contains the conventional drive and roll biasing members. It has been discovered that if the dummy slot fillers are made from a chopping blade by removing the chopping portion of the blade in a center portion, but leaving the chopping portion of the blade intact on the two end portions of the blade so that the end portions of the dummy blade slot fillers contact the working layer of the backup roll in a normal manner, most or all of the vibration caused by the conventional dummy slot filler pieces that allow vibration is eliminated, the life of the backup rolls and blade rolls are increased significantly and other benefits are also provided. The invention also includes a method of chopping items as described above using the improved chopper blade roll and chopper described herein wherein one or a plurality of the items are fed into the chopper of the invention having the chopper blade roll of the invention, chopped into lengths of at least 25 mm, more typically at least about 35 mm and most typically at least about 40 mm.

The invention uses dummy blade slot fillers according to the invention for a blade roll for a chopper for chopping one or more unwound items selected from a group consisting of fibers, fiber strands, wires, strings, tape(s), strip(s) and ribbon(s) into short lengths, the dummy blade slot filler comprising a slot filler section in the center portion of the dummy blade slot filler and a slot filler plus a chopping blade edge and a tapered section between the slot filler and the blade edge on each end portion of the dummy blade slot filler. The height of the edge on each end portion of the dummy blade slot filler is such that when installed in a slot in the blade roll the top edge of the blade will be about the same height above the top of the slots as the top edge of the chopping blades in the blade roll.

By about the same height above the top of the slots means within about +2 mm to about −2 or 3 mm, more typically within about +/−1.5 mm and most typically within about +/−1-1.3 mm of the height of the edge of the chopping blades above the top of the slot it resides in in the blade roll. The blade edge of the dummy blade slot filler can be like a chopping blade edge, can be a worn edge and even a badly worn edge.

The invention also includes a blade roll for a fiber chopper for chopping one or more unwound items selected from a group consisting of fibers, fiber strands, wires, strings, tape(s), strip(s) and ribbon(s) into short lengths, the blade roll comprising a blade holder having a plurality of slots spaced apart around the periphery of the blade holder and a plurality of chopper blades spaced apart with one or more blade holding slots between each pair of chopper blades, each chopper blade residing in one of the plurality of slots in the blade holder, and a dummy blade slot filler in each slot between each pair of chopper blades, the dummy blade slot filler comprising a slot filler section in the center portion of the dummy blade slot filler and a slot filler plus a chopping blade edge and a tapered section between the slot filler and the chopping blade edge on each end portion of the dummy blade slot filler. The thickness of the dummy blade slot filler should be the same or almost the same thickness as the chopping blades, which differ slightly from fiber manufacturer to fiber manufacturer and from blade supplier to blade supplier.

The invention also includes a chopper for chopping one or more unwound items selected from a group consisting of fibers, fiber strands, wires, strings, tape(s), strip(s) and ribbon(s) into short lengths, the chopper comprising a backup roll comprising an elastomeric working layer on its outer surface and a blade roll that works against the backup roll to form a nip for pulling and chopping the items at speeds exceeding 305 meters per minute, the blade roll comprising a blade holder having a plurality of slots spaced apart around the periphery of the blade holder and a plurality of chopper blades spaced apart with one or more blade holding slots between each pair of chopper blades, each chopper blade residing in one of the plurality of slots in the blade holder, and a dummy blade slot filler in each slot between each pair of chopper blades, the dummy blade slot filler comprising a slot filler section in the center portion of the dummy blade slot filler and a slot filler plus a chopping blade edge and a tapered section between the slot filler and the chopping blade edge on each end portion of the dummy blade slot filler.

When the word "about" is used herein it is meant that the amount or condition it modifies can vary some beyond that so long as the advantages of the invention are realized. Practically, there is rarely the time or resources available to very precisely determine the limits of all the parameters of one's invention because to do so would require an effort far greater than can be justified at the time the invention is being developed to a commercial reality. The skilled artisan understands this and expects that the disclosed results of the invention might extend, at least somewhat, beyond one or more of the limits disclosed. more of the limits disclosed. Later, having the benefit of the inventors disclosure and understanding the inventive concept and embodiments disclosed including the best mode known to the inventor, the inventor and others can, without inventive effort, explore beyond the limits disclosed to determine if the invention is realized beyond those limits and, when embodiments are found to be without unexpected characteristics, those embodiments are within the meaning of the term about as used herein. It is not difficult for the skilled artisan or others to determine whether such an embodiment is either as might be expected or, because of either a break in the continuity of results or one or more features that are significantly better than reported by the inventor, is surprising and thus an unobvious teaching leading to a further advance in the art.

BRIEF DESCRIPTION OF THE DRAWINGS

FIG. 2A is a partial perspective view of an assembled prior art blade roll.

FIG. 2B is a perspective view of a prior art dummy slot filler.

FIG. 3 is a perspective view of one embodiment of a dummy blade slot filler according to the invention.

FIG. 4A is a partial cross sectional view of the blade roll of the invention shown in FIG. 4 engaged with a backup roll and shows a dummy blade slot filler of the invention in relation to items being chopped.

DETAILED DESCRIPTION OF SOME EMBODIMENTS OF THE INVENTION

Figure 1:
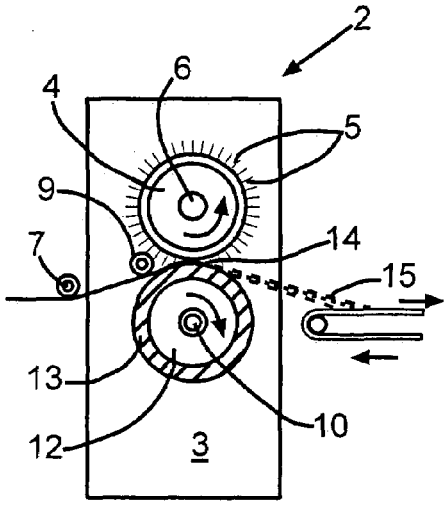
FIG. 1 (PRIOR ART)
FIG. 1 is a front view of a portion of a prior art chopper.
Figure 1A:
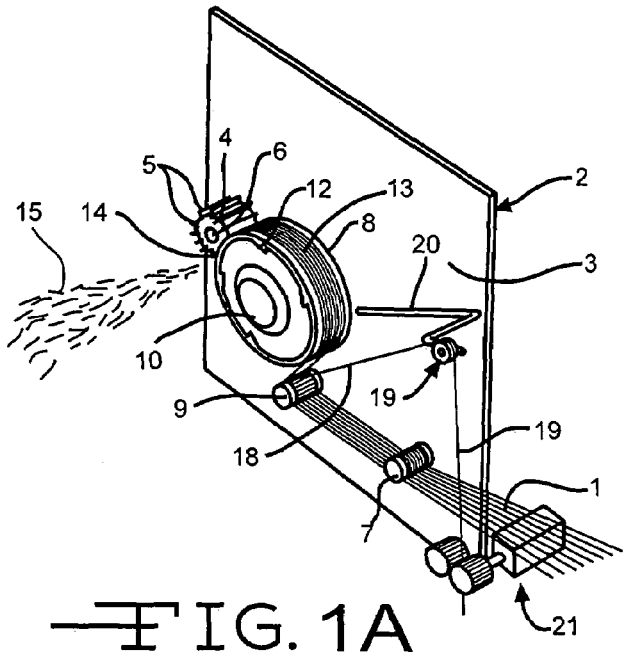
FIG. 1A (PRIOR ART)
FIG. 1A is an elevational perspective view of a portion of a different prior art chopper.

The chopper illustrated in FIG. 1, is like the chopper shown in U.S. Pat. No. 3,815,461, the disclosure of which is incorporated herein by reference. The choppers of FIGS. 1 and 1A are typical of the type of choppers suitable for use with the present invention, but other types of choppers having a blade roll with spaced apart blades that work against an elastomeric working layer of a backup roll are also usable with and in the invention. While these choppers are or will be shown pulling and chopping strands of glass fibers, these and the other suitable choppers can also be used according to the invention to pull and chop individual fibers, fiber strands of materials other than glass, wires, strings, tape(s), strip(s), ribbon(s) and similar items.

FIG. 1A shows a front elevation perspective view of a portion of a prior art chopper 2, of the type shown in U.S. Pat. No. 4,551,160, and that is used in making chopped strand glass fiber. It comprises a cabinet front 3, a blade roll 4 with spaced apart blades 5 contained in slots and projecting from the periphery of an integrated hub 6, a backup roll 8 and a free-wheeling idler roll 9. The blade roll 6 is usually made entirely of metal, but can be made using a thermoplastic material to hold spaced apart blades such as the blade rolls shown in U. S. Pat. Nos. 4,083,279, 4,249,441 and 4,287,799, the disclosures of which are herein incorporated by reference. The backup roll 8 is held on a spindle and hub 10. The backup roll 8 is biased against the blade roll 4 until the blades 5 press into the working layer of the backup roll 8 a proper amount forming a nip 14 to break or separate fiber strands 1 into an array of short length or chopped strands 15.

One or more, usually five or more and up to 14 or more strands 1, such as glass fiber strands, each strand containing 400-6000 or more fibers and usually having water and/or an aqueous chemical sizing on their surfaces, are pulled by the backup roll 8 into the chopper 2 and the nip 14. The strands 1 first run under a grooved guide roll 7, preferably with one or two strands 1 in each groove, partially around an idler roll 9 and upward and over an elastomeric working surface 13 of the backup roll 8, i.e. the exposed peripheral surface of the backup roll 8 on which the running strands 1 lay against and are supported while being severed by blades 5 on the blade roll 4. The working surface of the back up roll 8 is typically wider than the oscillating path of the glass fiber strands 1. The strands 1 then pass under the outer surface of the free-wheeling idler roll 9 located to provide sufficient contact of the strands 1 on the surface of the working layer 13 on the backup roll 8 enabling the latter to pull the glass fiber strands 1.

When a new strand 18 is ready to be started into the prior art chopper it is pulled to the front of the chopper 2 by the operator and pulled under the separator roll 7 and the idler roll 9 and up over a fixed, preferably non-freewheeling starter roll 19 attached to the end of a pivoting arm 20 and down between a nip of a pair of driven pull rolls, part of a conventional conventional pull roll assembly 21, that pull the new strand 18 at a first low speed and deliver the new strand into a conventional scrap processing system, scrap bin or scrap basement. After the new strand 18 is being pulled by the pull roll assembly 21 at a low initial speed, the pull rolls 21, the pulling speed of the pull rolls 21 is ramped up to bring the new strand 18 to at least close to the speed of the strands 1 running into the chopper 2. When that speed is reached, the pivot arm 20 is pivoted counterclockwise to start the new strand 18 into the chopper 2 in the manner disclosed in U.S. Pat. No. 4,551,160.

Figure 2:
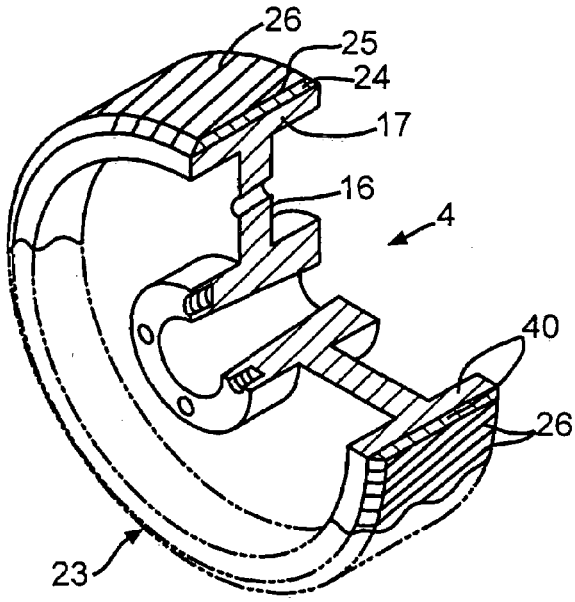
FIG. 2 (PRIOR ART)
FIG. 2 is a partial perspective view of one prior art blade holder for a blade roll.

FIG. 2 shows a typical blade roll wheel 23 for a blade roll 4, without the blades 5. A portion of the blade roll 23 is cut away to better illustrate the blade roll assembly. The blade roll 4 is typically comprised of a hub supporting a rim 17. The rim 17 holds an elastomeric working layer that the chopper blades 5 work against. The blades 5 usually must penetrate the top surface 25 a desired distance as is well known to chop all the fibers or other items. The chopping blades 5 sit in slots 26 that extend part of the way through the thickness of the working layer 24, usually half way or more through the thickness of the working layer 24, and rest on the bottom of the slots 27. The working layer 24 can be most any elastomeric material having a hardness sufficient to hold the blades and typically is a polyurethane or rubber material. FIG. 2A, a partial perspective view of the same blade roll wheel 23 as shown in FIG. 2, has blades 5 in some of the slots 24 of the working layer 24 and a blade retention ring 28 held in place on the blade roll with bolts 30 that screw into threaded holes 31 in the rim 17 of the blade roll wheel 23. The blades 5 are held securely in place as the blade retention rings 28 (the blade retention ring on the backside of the backup roll 4 is not shown, but is just like the front blade retention ring 28 that is shown) with a cushion ring 29 of compressible material as shown and described in U.S. Pat. No. 4,249,441, the disclosure thereof being incorporated herein by reference. The cushion ring 29 is held in place with an annular bead 32 that fits into an annular groove 33 in an inner face of the blade retention ring 28.

It is very costly and storage space intensive to inventory slotted blade rolls 4 for every length of item that will be produced in a reasonable period of time, particularly considering the life of a blade roll, usually about 4-36 hours depending on the item and type of product being produced, and the large number of choppers required for a typical manufacturing company, typically about 4-50 choppers or more, usually more than 10-20 choppers. The product lengths, and therefore the center to center distance between the slots 26 will typically include about 25-26 mm, about 30-335 mm and about 40-55 mm and greater, but other and greater, but other chopped lengths are also frequently required. To minimize the number of blade roll wheels that must be inventoried, the slots 26 in the elastomeric working layer 24 are spaced to a make short length product, a spacing that other lengths are a multiple of, e.g about. 6-7, 12-13, 18-19 or 25-26 mm. When a product length scheduled for production that is a multiple of the close slot spacing, dummy slot fillers like the one shown in FIG. 2B as 34 are placed in the slots between the blades 5 that are spaced to produce the scheduled product. For example, if a 24-26 mm long chopped product is scheduled and the slot 26 spacing in the new elastomeric working layer 24 of a blade roll wheel 23 is 6-7 mm, there will be three empty slots 26 between each pair of blades 5 spaced 24 mm apart, blade edge to blade edge. In the past, a dummy slot filler 34 was placed in each empty slot 26. The blade retainer rims 28 hold the dummy slot fillers 34 in place in the same manner as they hold the blades 5 in place. The dummy slot fillers 34 were usually made by removing a blade edge portion 36 from a used blade 5 having a worn edge 38. Enough of the blade edge portion 36 was removed to produce a height H of the dummy slot fillers 34 equal to or almost equal to the depth of the slot 26 in the elastomeric working layer 23 such that a top surface 37 of the dummy slot filler 34 was even with, or just slightly below, the top surface 25 of the working layer 24. This has addressed the blade roll wheel 23, or slotted elastomeric working layer 24 inventory problem.

It has now been discovered that the vibration when making longer chopped lengths is due to excessive space between blades and that the level of vibration in the chopper 2 is much reduced when chopping to make products like about 25 mm or longer, particularly like about 30 mm or longer and most especially like about 50 mm or longer. It has been concluded that this greater vibration is caused by the blades 5 and the cuts they make in the working layer 24 getting out of sync while the blades 5 and the working layer 24 are out of contact with each other due to the long gap between blades 5. It has been discovered that if a dummy blade slot filler, like the embodiment shown in FIG. 3, is produced, the vibration is substantially reduced when making chopped products of at least about 50 mm or longer and significantly reduced when making about 25 mm long or longer products including products over about 30 mm long like 35, 40, and 45 mm. The longer the chopped product, the more pronounced, or the greater, the improvement.

The dummy blade slot filler 40 shown in FIG. 3 can be made from a new blade 5 or a used or even badly worn blade 5. The dummy blade slot filler 40 is made by removing a center portion 46 of the blade edge 44, leaving an end portion of the blade edge 44 unaffected on each end portion of the blade edge 38. Used blades 5 can be used to make the dummy blade slot fillers 40 and new blades 5 can also be used. It has been found that it is not necessary to have sharp edges on the blade edges 44 of the dummy blade slot filler 40. The height H of the ground down center portion W is equal to or almost equal to the depth of the slots 26 such that the top surface 47 of the ground down portion W is flush with, or almost flush with the top surface 25 of the elastomeric working layer 24. By the term "ground down" is meant to include any manner of removing the center portion 46 including laser cutting, milling, etc. By "almost flush" with the top surface 25 is meant within 0.5 mm of the top surface 25, particularly below the top surface 25 no more than about 0.5 mm, but flush with the top surface 25 is preferred. The width of the blade edge 44 can be from about 3 mm to about 13 mm, but more typically is about 4-10 mm and most typically is about 5-8 mm.

Figure 4:
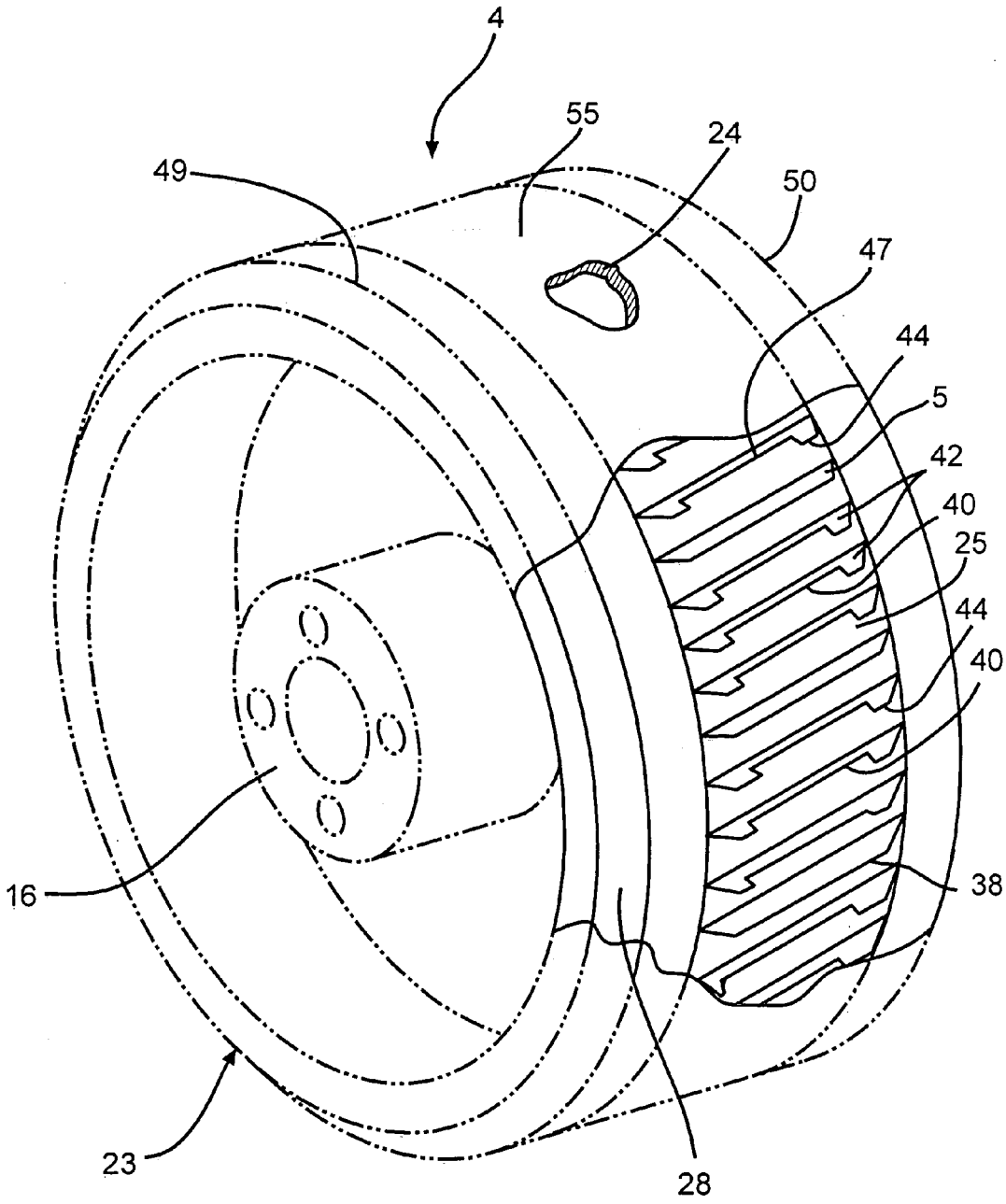
FIG. 4 is a partial perspective view of an assembled blade roll of the invention containing chopping blades and dummy blade slot fillers of the invention.

FIG. 4 shows one embodiment of a blade roll according to the invention. In this blade roll, the slots 26 in the working layer 24 (see Fig. FIG. 2) are spaced about 6 mm apart. The blade roll is set up to produce about 25-26 mm product with chopping blades 5 spaced such that the distance between chopping edges 38 of the blades 5 have this spacing. The slots 26 between each pair of blades 5, three in this embodiment, are each filled with a dummy blade slot filler 40 of the invention such that the chopping edges of the blades 5 and the edges 44 of the dummy blade slot fillers 40 on each side of each blade 5 are spaced about 6 mm apart, and the spacing between the edges 44 of the dummy blade slot fillers 40 are also spaced about 6 mm apart in this embodiment. The top surface 47 of the central portion W of each dummy blade slot filler 40 is flush or near flush with the exposed surface 25 of the elastomeric layer 24 having a working zone 55. With this and other embodiments of the invention, the blades 5, combined with the edges 44 are in contact with the working layer 13 of the backup roll 12 substantially more frequently than with prior art blade rolls resulting in elimination of, or substantial reduction in, vibration in the chopper. The width of the blade portions 44 is usually about 5 mm beyond the item or fiber chopping zone 47, but this can vary some depending upon the width of the backup roll 24 working zone 55 and the width of the chopping zone 47. The width of the blade portions 44 should be sufficient to width of the blade portions 44 should be sufficient to have enough strength to not break during normal operation, but need not be more than about 3-6 mm, though they can be, and about 5 mm works good.

As mentioned earlier, the chopping width of the working layer 24 is less than the total width of the working layer 24. As shown in FIG. 4A, the width W of the ground down center portion 46 of the dummy blade slot filler 40 is at least as wide as the chopping width of the working layer 24 and more typically is at least 105-120 percent of the width of the chopping width to allow for oscillation of the fiber strands on the working layer 24. When the items being chopped are oscillating back and forth on the surface 25 of the working layer 23, a conventional practice, the chopping width is greater than the width of the array of items at any point in time and this oscillating width is the chopping width. The end portions 42 of the blade edges 44 contact the outer end portions of the working layer 24 in the same manner as the chopping blades 5 while the top surface 47 of the dummy blade slot filler 40 do not damage the items being chopped, such as the fiber strands 1. Typically the outer ends of the end portions 42 extends to the edges 49 and 50 respectfully of the working layer 24, but as shown in FIG. 4A, the outer ends of the end portions 42 of the dummy blade slot fillers 40 can extend beyond the outer edges 49,50 by about 1-4 mm or more and also can end short of the outer edges 49,50 by about 1-13 mm.

The dummy blade slot filler 40 can also be made just like the chopping blades 5 are made by starting with a blank that looks similar to that shown in FIG. 3 and then sharpening only the blade edge portions 44, but they need not be as sharp as the blade edges 38 and this procedure may be less expensive than starting with normal chopping blades 5.

The dummy blade slot fillers 40 can be installed in the appropriate slots 26 of the elastomeric working layer 24 in the same manner as the chopping blades 5 are installed and can be held in place in the blade roll 4 in the same manner as the chopping blades 5 are held in place. The width of the dummy blade slot fillers 40 can be such that the blade edges 44 end at one or both of the edges 49,50 of the working layer 24, can extend beyond one or more of the edges 49,50 of the working layer 24 or can end before one or both of the edges 49,50 of the working layer 24 as shown in FIG. 4, and most desirable are of the same outside width as the outside width of the blade edge of the chopping blades 5 being used in blades 5 being used in that working layer 24. No maintenance is required on the dummy blade slot fillers 40 during the first several hundred hours of operation. After that, the worn blade portions 44 can be re-sharpened if desired and reused.

Different embodiments employing the concept and teachings of the invention will be apparent and obvious to those of ordinary skill in this art and these embodiments are likewise intended to be within the scope of the claims. The inventor does not intend to abandon any disclosed inventions that are reasonably disclosed but do not appear to be literally claimed below, but rather intends those embodiments to be included in the broad claims either literally or as equivalents to the embodiments that are literally included.

The invention claimed is:

1. A chopper for chopping one or more unwound items selected from a group consisting of fibers, fiber strands, wires, strings, tape(s), strip(s) and ribbon(s) into lengths of at least about 25 mm, the chopper comprising a backup roll comprising an elastomeric working layer on its outer surface, the working layer having a width that comprises a chopping zone where the unwound item(s) contact the working layer during chopping and a blade roll comprising a plurality of blades having chopping edges that work against the working layer of the backup roll to form a nip for pulling and chopping the items at speeds exceeding 305 meters per minute, the blade roll comprising a blade holder having a plurality of slots spaced apart around the periphery of the blade holder and a plurality of chopper blades spaced apart with one or more blade holding slots between each pair of chopper blades, each chopper blade residing in one of the plurality of slots in the blade holder, and a dummy blade slot filler being located in each of the slots between each pair of chopping blades, each dummy blade slot filler comprising a center portion of the dummy blade slot filler having a height that is equal to or within about 0.5 mm of the depth of the slot it fills and a length at least as long as the width of the chopping zone, each dummy blade slot filer also having a blade edge and a tapered section adjacent each end of the center portion and on each end portion of the dummy blade slot filler, the height of the blade edge on the blade edge and tapered portion above the top of the slots in the blade roll being within +2 mm to about minus 3 mm of the height of the chopping edges of the chopper blades.

2. The chopper of claim 1 wherein the length of the center portion of the slot filler is about 105 percent to about 115 percent of the width of the chopping zone that will be contacted with an array of the unwound items to be chopped into said lengths and the width of each blade edge is in the range of about 4 mm to about 13 mm.

3. The chopper of claim 2 wherein the chopping blades are spaced apart on the blade roll a distance of at least about 40 mm.

4. The chopper of claim 3 wherein the height of the blade edge on the blade edge and tapered sections on the dummy slot fillers extends above the top of the slots a distance that is within +/−1.5 mm of the height of the chopping edges of the chopper blades.

5. The chopper of claim 2 wherein the height of the blade edge on the blade edge and tapered sections on the dummy slot fillers extends above edges of the chopper blades.

6. The chopper of claim 1 wherein the width of the blade edge and tapered section on each end portion of the dummy blade slot filler is in the range of about 4 mm to about 10 mm.

7. The chopper of claim 1 wherein the width of the blade edge and tapered section on each end portion of the dummy blade slot filler is in the range of about 4 mm to about 10 mm.

8. The chopper of claim 7 wherein the chopping blades are spaced apart on the blade roll a distance of at least about 40 mm.

9. The chopper of claim 8 wherein the height of the blade edge on the blade edge and tapered sections on the dummy slot fillers extends above the top of the slots a distance that is within +/−1.5 mm of the height of the chopping edges of the chopper blades.

10. The chopper of claim 1 wherein the chopping blades are spaced apart on the blade roll a distance of at least about 30 mm.

11. The chopper of claim 1 wherein the chopping blades are spaced apart on the blade roll a distance of at least about 40 mm.

12. The chopper of claim 11 wherein the height of the blade edge on the blade edge and tapered sections on the dummy slot fillers extends above the top of the slots a distance that is within +/−1.5 mm of the height of the chopping edges of the chopper blades.

13. The chopper of claim 1 wherein the height of the blade edge on the blade edge and tapered sections on the dummy slot fillers extends above the top of the slots a distance that is within +/−1.5 mm of the height of the chopping edges of the chopper blades.

* * * * *